US008022885B2

(12) United States Patent
Smoyer et al.

(10) Patent No.: US 8,022,885 B2
(45) Date of Patent: Sep. 20, 2011

(54) SYSTEM AND METHOD FOR RE-ALIGNING ANTENNAS

(75) Inventors: Clinton J. Smoyer, Raymore, MO (US); Shane M. Smith, Paola, KS (US)

(73) Assignee: Embarq Holdings Company, LLC, Overland Park, KS (US)

( * ) Notice: Subject to any disclaimer, the term of this patent is extended or adjusted under 35 U.S.C. 154(b) by 363 days.

(21) Appl. No.: 11/888,832

(22) Filed: Aug. 2, 2007

(65) Prior Publication Data

US 2009/0033576 A1 Feb. 5, 2009

(51) Int. Cl.
*H01Q 3/00* (2006.01)

(52) U.S. Cl. ..... 343/763; 343/757

(58) Field of Classification Search ..... 343/757, 343/765, 766, 882, 878, 880, 761, 763; 342/359
See application file for complete search history.

(56) References Cited

U.S. PATENT DOCUMENTS

| | | | | |
|---|---|---|---|---|
| 5,420,597 | A * | 5/1995 | Duncan | 343/703 |
| 6,295,034 | B1 * | 9/2001 | Brown et al. | 343/781 CA |
| 6,661,373 | B1 * | 12/2003 | Holliday | 342/359 |
| 2008/0088518 | A1 * | 4/2008 | Charash et al. | 343/757 |

* cited by examiner

*Primary Examiner* — Jacob Y Choi
*Assistant Examiner* — Robert Karacsony
(74) *Attorney, Agent, or Firm* — SNR Denton US LLP

(57) ABSTRACT

A system for re-aligning an antenna communicating signals point-to-point. The system may include a first antenna, a second antenna configured to communicate a communications signal with the first antenna using point-to-point communications, and a position controller coupled to the first antenna and configured to re-align the first antenna with respect to the second antenna in response to determining a misalignment of the antenna.

22 Claims, 7 Drawing Sheets

SYSTEM AND METHOD FOR RE-ALIGNING ANTENNAS

BACKGROUND OF THE INVENTION

Antennas are used for a wide-variety of communications applications. One of the more recent applications for antennas has been for communications of point-to-point links for wireless fidelity "WiFi" communications. Various types of antennas may be used for point-to-point links for WiFi communications, but longer range communications, such as 20 miles, typically use dish-style antennas that have a radiation pattern that focuses an antenna beam more intensely along a communication path with another antenna. For example, while a flat panel antenna may have an antenna beam with a 60 degree angle, a dish antenna may have an antenna beam with a 6 degree angle, a much narrower beam than the flat panel antenna beam.

While the use of dish antennas for WiFi and other network communications is useful for providing long-distance communications between antennas, dish antennas that have such a small angle can result in problems if a misalignment occurs, especially at long distances. Misalignment of a dish antenna as small as one-half an inch can cause a dramatic loss of power at a range of 20 miles, for example, due to the antenna pattern not being focused on an antenna to which the dish antenna is in communication.

These antennas are often mounted on towers that situate the antennas between 50 feet and 400 feet above the ground. Dish antennas that may be used for such long distance communications are generally in the 18-inch to 6 foot diameter range and may weigh 100 to 150 pounds. The use of such large antennas may provide for communications qualities suitable for network communications, but may be problematic for maintaining alignment.

FIG. 1 is an illustration of a conventional point-to-point antenna communications system 100 illustrating the aforementioned misalignment of the antennas. FIG. 1 depicts two towers 102*a* and 102*b* with antennas 106*a* and 106*b* being coupled to the towers using mounts 104*a* and 104*b*. The mounts 104*a* and 104*b* typically include brackets and other hardware to lock the associated antenna in a fixed position on the respective towers. As a result of a slight misalignment, the signal 108 from antenna 106*a* is angled slightly downward, away from the receiving antenna 106*b* and, therefore, the antenna pattern 110 of the signal 108 is outside of the optimal receiving range of the receiving antenna 108.

Alignment problems may result from a number of reasons, including, and most often, weather conditions. Even though the brackets 104*a* and 104*b* are configured to lock the antennas 106*a* and 106*b* in a fixed position, weather conditions that produce a lot of wind, such as rainstorms and hurricanes, may cause the dish antennas being used for point-to-point network communications to become misaligned such that point-to-point communications degrade. While storms can be a problem, because an antenna may be located high above the ground, a ground wind speed of 20-30 miles per hour may be a wind speed of 80-100 miles per hour at the antenna. While these problems are generally associated with dish antennas being mounted on towers, the same or similar problems may exist from non-dish antennas or antennas positioned on other structures, such as buildings, poles, or the ground.

One problem that occurs due to the degradation of communications is that reliability of a network degrades to the point of an outage occurring. If an outage occurs for more than 6 minutes, a report to a governmental body, such as the Federal Communications Commission, must be made and, in some cases, fines may be imposed on a communications carrier that operates the network or maintains the communications link between the point-to-point antennas. Furthermore, the antenna manufacturer may have to lower reliability reporting of the antenna (e.g., from 0.999 to 0.99), which may cause communications carriers to lower their desire to purchase the antenna.

Another problem that results from misalignment of an antenna is that the cost for re-alignment pole or tower climbers (i.e., technicians who climb communications poles or towers) is expensive. For example, for a pole climber to climb a communications tower and re-align an antenna may cost $1,000 or more for a single climb. Furthermore, pole climbers are limited in supply and the time to have one perform the re-alignment may take hours or days. If a misalignment occurs during a storm with precipitation, pole climbers cannot climb the pole, so the misalignment may not be corrected until the storm passes, which may sometimes take several days. The costs due to misalignment may further be measured in customer attrition, which, if a misalignment occurs each time the wind blows strongly, can be significant.

SUMMARY OF THE INVENTION

To overcome the problems associated with antennas used for point-to-point communications, the principles of the present invention provide for auto re-alignment or remote re-alignment of antennas. By either the antenna being able to self re-align or an operator being able to remotely re-align the antenna, the cost and delay of an antenna becoming misaligned may be reduced for a network operator. Furthermore, reliability of a network link that uses an antenna that is configured using the principles of the present invention may be improved or otherwise remains high.

One embodiment includes a system for communicating signals point-to-point. The system may include a first antenna, a second antenna configured to communicate a communications signal with the first antenna using point-to-point communications, and a position controller coupled to the first antenna and configured to re-align the first antenna with respect to the second antenna in response to determining a misalignment of the antenna.

Another embodiment may include a method for communicating signals point-to-point. A first antenna may receive a communications signal communicated to the first antenna in a point-to-point manner from a second antenna. A determination that the first antenna is misaligned may be made. At least one offset angle for re-aligning the first antenna may be determined. The first antenna may be re-aligned based on the offset angle(s) independent of a person having to perform the re-alignment at the first antenna.

BRIEF DESCRIPTION OF THE DRAWINGS

The present invention is described in detail below with reference to the attached drawing figures, wherein.

DETAILED DESCRIPTION OF THE INVENTION

The principles of the present invention provide a system and method for re-aligning antennas. The description that follows is directed to one or more embodiments, and should not be construed as limiting in nature. In one embodiment, an auto-sensing algorithm is incorporated into a position controller that is attached to an antenna to automatically adjust the elevation and azimuth positions of the antenna. The principles of the present invention may also include a semi-automatic and manual mode for allowing a remote operator to manually adjust the antenna using signal strength or position information returned from a position controller.

Figure 1:
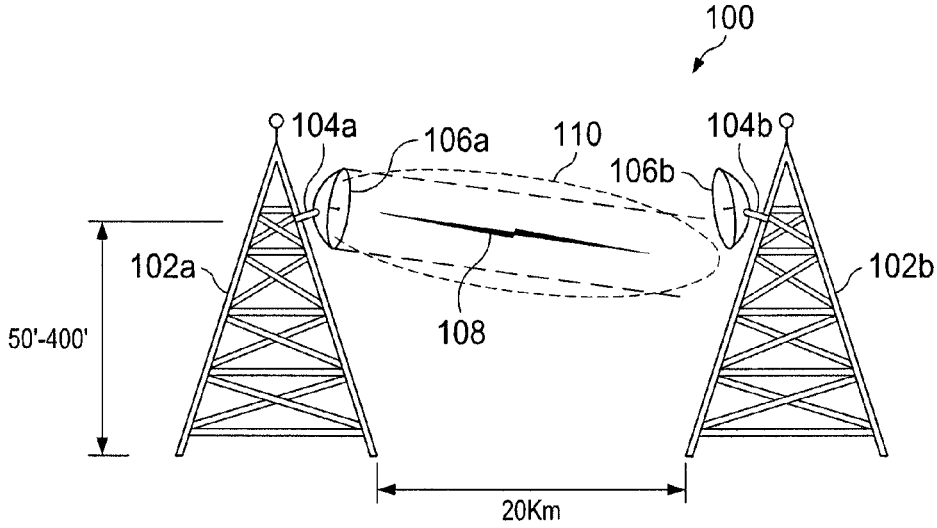
FIG. 1 (PRIOR ART)
FIG. 1 is an illustration of a conventional point-to-point antenna communications system that depicts a misalignment of the antennas.
Figure 2A:
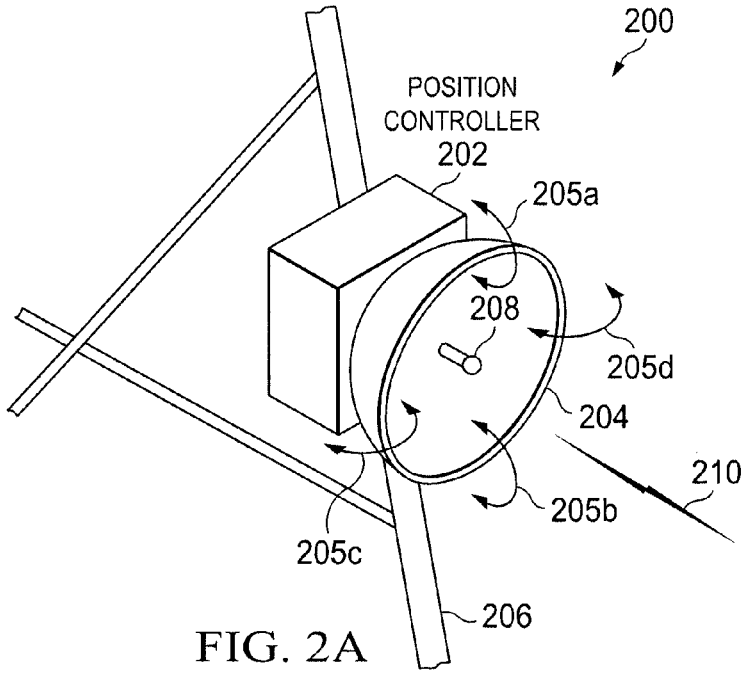
FIG. 2A is an illustration of an exemplary antenna system including a position controller for re-aligning an antenna.

FIG. 2A is an illustration of an exemplary antenna system 200 including a position controller 202 for re-aligning an antenna. The position controller 202 may be configured to rotate the antenna 106 in both the elevation and azimuth directions as depicted by rotation arrows 205*a*-205*d*. In one embodiment, the position controller 202 and antenna 204 are integrated as a single unit. Alternatively, the position controller 202 and antenna 204 are separate components that may be coupled together during installation.

The position controller 202 may be mounted to tower 206. Although shown as a tower 206, the position controller 202 may be mounted to a variety of structures, including buildings, poles, or otherwise. The position controller 202 remains stationary relative to the tower 206, while the position controller 202 may adjust position of the antenna 204 in a range of directions. Being able to adjust the position of the antenna 204 in azimuth and elevation angles allows an antenna element 208 used for transmitting and receiving communications signals 210 to be re-aligned for improving communication performance, especially when used in point-to-point communications.

Figure 2B:
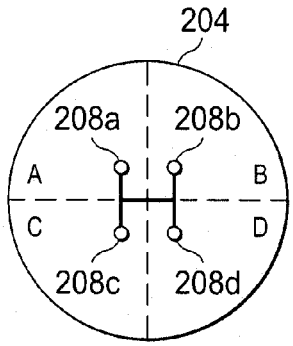
FIG. 2B is an illustration of a frontal view of the antenna of FIG. 2A depicting four antenna elements used for sensing communications signals.

FIG. 2B is an illustration of a frontal view of the antenna 204 of FIG. 2A depicting four antenna elements 208*a*-208*d* (collectively 208) used for receiving communications signals. These antenna elements 208 may also be used for transmitting the communications signals. Alternatively, another antenna element (not shown) positioned in front of a center point of the antenna 204 may be used to transmit the communications signals. As understood in the art, the antenna elements 208 may be positioned to receive the communications signals reflected from quadrants A, B, C, and D of the antenna 204, respectively. Collecting communications signals reflected from each quadrant of the antenna enables power being received at each quadrant to be separately determined and used for re-aligning the antenna. The antenna elements 208 being separate elements is exemplary. Other configurations are possible, including an antenna array positioned at a focal plane of the dish antenna 204.

Figure 2C:
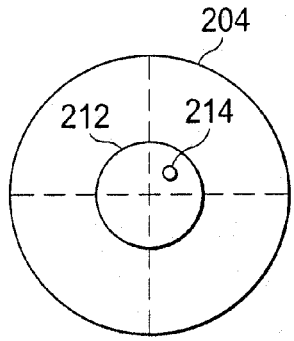
FIG. 2C is an illustration of a frontal view of the dish antenna of FIG. 2A depicting an antenna array used for sensing communications signals at a focal plane of the dish antenna.

FIG. 2C is an illustration of a frontal view of the dish antenna 204 of FIG. 2A depicting an antenna array 212 used for sensing communications signals from the dish antenna 204. The antenna array 212 is positioned in a focal plane of the dish antenna 204. The focal plane is the distance at which radio frequency communications signals are focused from the dish antenna 204 to maximize signal power. If the dish antenna 204 is aligned such that it is pointing directly toward another antenna with which communications signals are being communicated, the communications signals will be focused at the center point of the antenna array 212 (i.e., the antenna array is at boresight). If, however, the dish antenna 204 is misaligned, the communications signals being reflected from the dish antenna 204 will be focused off of the center of the antenna array 212, such as at focal point location 214. The antenna array 212 may be configured such that the position controller 202 can determine the position of the focal point location 214 and re-align the dish antenna 204 to cause the focal point location 214 to be re-centered on the antenna array 212.

Continuing with FIG. 2B, communication signals 210 communicated between antennas may be composed of any type of communications signal, including WiFi signals. In alternate embodiments, there may be more than four antenna elements, such as an antenna array, representing a larger number of subdivisions of the antenna 204 for more precise communications signal sensing. In other words, signal strength in any given location on the antenna can be more finely detected based on a higher number of inputs. The use of four or more antenna elements 208 provides for sensing signal strength being received by the antenna 204 to enable determination of antenna orientation or alignment, thereby enabling a determination of re-alignment in the event of the antenna 204 becoming misaligned due to weather conditions, for example.

Figure 2D:
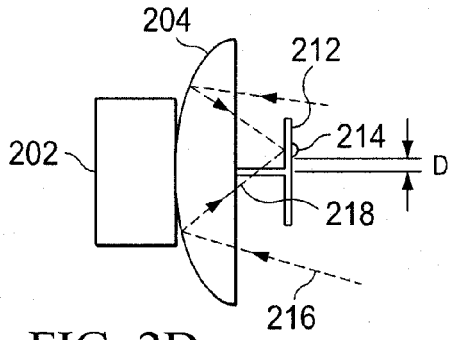
FIG. 2D is an illustration of a side view of the dish antenna of FIG. 2C depicting the antenna array positioned at a focal plane of the dish antenna.

FIG. 2D is an illustration of a side view of the dish antenna 204 of FIG. 2C depicting the antenna array 212 positioned at a focal plane of the dish antenna 204. As shown, a communications signal 216 is incident on the dish antenna 204 and is reflected onto the antenna array 212 at a focal point 214. The focal point 214 of the reflected communications signal 218 is shown to be at an offset distance D from boresight, which can also be represented as azimuth and elevation angles (AZ, EL). The position controller 202 may use information of the offset distance and re-align the antenna to boresight, thereby minimizing loss of communications signals or information contained in the communications signals.

Figure 3:
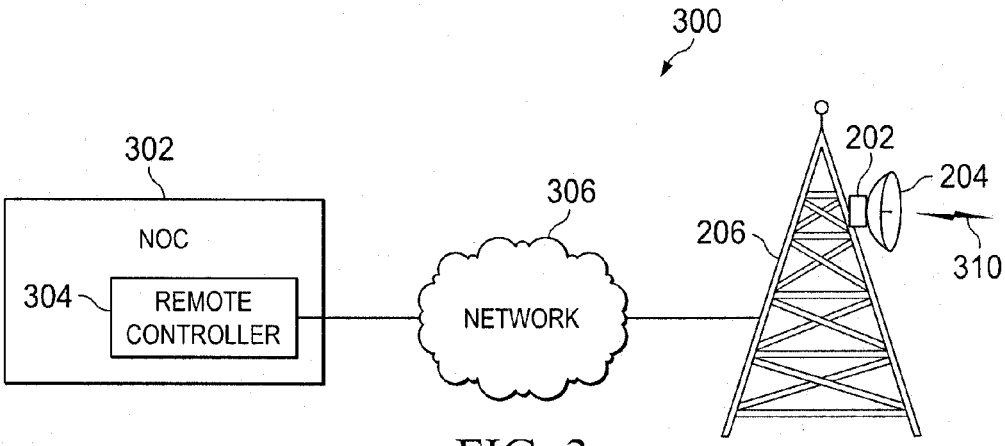
FIG. 3 is an illustration of an exemplary communications system enabling remote re-alignment of an antenna.

FIG. 3 is an illustration of an exemplary communications system 300 enabling remote re-alignment of an antenna 204. In one embodiment, the principles of the present invention include a network operations center (NOC) 302 operating a remote controller 304 in communication, via a network 306, with the position controller 200 (FIG. 2). The NOC 302 is located remotely from the tower 206 and uses the remote controller 304 for manually, semi-automatically, or automatically controlling the direction of the antenna 204. The remote controller 304 receives signal data provided by the position controller 202 over the network 306. The operator can view a display (FIG. 5) showing signal strengths received from each antenna element 208 and manually adjust the direction of the antenna from the remote NOC 302. In an automatic adjustment embodiment, the remote controller 304 may receive signals from the position controller 202, but the user would not manually control the antenna as the antenna 204 would be controlled using embedded algorithms at the remote controller similar or the same as those in the position controller 202. In any embodiment (i.e. automatic, semi-automatic, or manual), the system can be configured to notify an operator of the antenna 106 when the power level of the communications signal drops below a set threshold (e.g., −3 dB below an initial setting). In one embodiment, a calibrated communications signal having a predetermined power level that causes a certain measured power level at the position controller 202 or remote controller 304 to be measured may be communicated periodically, aperiodically, in response to an event, or by an operator to cause re-alignment of the antenna. The calibrated communications signal may include re-calibration triggering information, such as a specific sequence of bits that the position controller 202 or remote controller 304 can identify and execute a re-calibration operation based on the received calibration signal.

Figure 4:
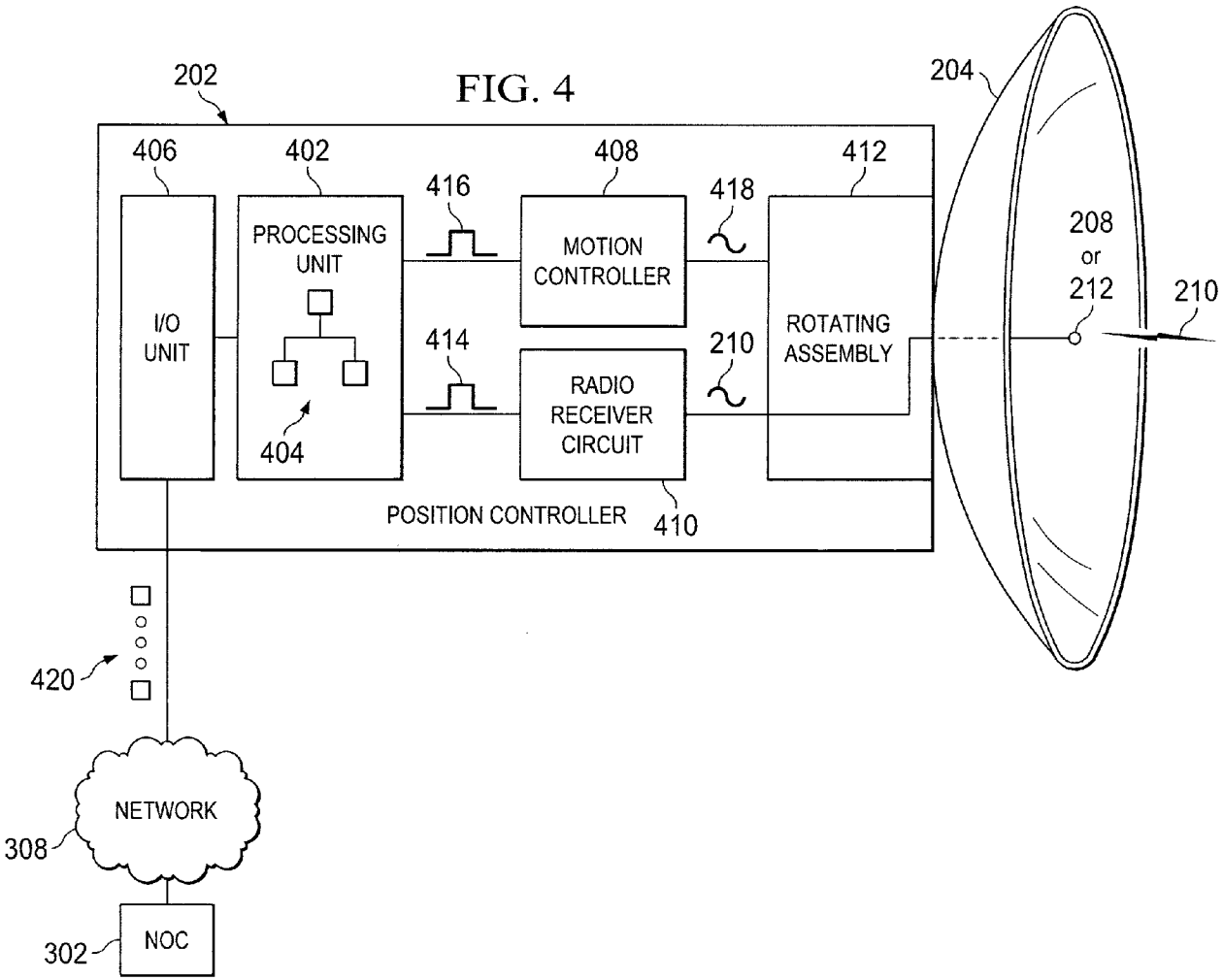
FIG. 4 is a depiction of an exemplary position controller for use in re-aligning an antenna.

FIG. 4 is a depiction of an exemplary position controller 202 for use in re-aligning an antenna 204. The position controller 202 includes a processing unit 402 that executes software 404. The processing unit 402 may be in communication with an input/output (I/O) unit 406, motion controller 408, and radio receiver circuit 410. The motion controller 408 may be in communication with a rotating assembly 412, which is coupled to antenna 204 for re-aligning the antenna 204. The software 404 may be configured to perform automatic feedback processing for re-aligning the antenna 204. In one embodiment, the position controller 202 may be a stand-alone device, such that the position controller 202 does not communicate or receive position information from a remote device, such as the remote controller 304, of the antenna 204, but may communicate information received from communication signals 210 as received by antenna element 208. The software 404 may be configured to perform automatic position control for controlling re-alignment operations of the antenna 204 based on the communication signals 210 received by the antenna element 208. In one embodiment, the processing unit 402 executing the software 404 may perform conventional automatic position control functionality, such as using a proportional-integral-derivative (PID) control algorithm, in both azimuth elevation planes. In performing the position control functionality, the radio receiver circuit 410 receives the communications signals 210 from an antenna element, where the antenna element may be an antenna element 208 (FIG. 2B) or antenna array 212 (FIG. 2C). The radio receiver circuit 410 may perform an analog-to-digital (A/D) conversion to convert the communication signals 210 into digital signals 414.

In the case of the communication signals 210 being received by four or more antenna elements 208, the radio receiver circuit 410 may convert the communication signals 210 received from each of the individual antenna elements 208 and the software 404 may distinguish between each of the signals being received by the different antenna elements 208. The software 404 may perform difference and summation algorithms to determine signal strengths being received by each antenna element 208 so that a re-alignment determination for the antenna 204 may be made. In other words, the antenna elements 208 that are positioned in different quadrants of the antenna may be used to perform re-alignment of the antenna 204 depending upon which quadrant is receiving communications signals 210 with the highest power. Performing such determination using software is well understood in the art of object tracking using remote sensors. In the case of using an antenna array, such as antenna array 212 of FIG. 2C, then a determination of peak power location may be made by the processing unit 402 to determine position of the communications signals focused on the antenna array 212 by the dish antenna 204. The processing unit 402 may use the position of the communications signals focused on the antenna array 212 as feedback to re-align the dish antenna 204.

If, rather than using the communications signals as feedback electromechanical or optical components of the rotating assembly 412 are used to monitor alignment of the dish antenna 204, then the processing unit 402 may be configured to receive feedback signals from the rotating assembly 412 and use those signals to re-align the dish antenna 204. The position controller 202, in this instance, may be established with an initial boresight alignment and use angular offsets from that initial boresight to re-align the antenna 204. The automatic control algorithms for maintaining alignment of the antenna 204 is understood in the art. Such re-alignment may be performed continuously, periodically, or otherwise.

The processing unit 402 may generate command signals 416 based on determining the position of the aggregated or focused communications signals and communicate the command signals 416 to the motion controller 408. The motion controller 408, in response to receiving the command signals 416, may perform a digital-to-analog (D/A) conversion and generate analog command signals 418 for communication to the rotating assembly 412. The rotating assembly may be configured to receive the analog command signals 418 and perform an electromechanical operation to drive or otherwise reposition the antenna 204 for re-alignment. The rotating assembly 412 may include motors, gears, and other mechanical drive components in both elevation and azimuth planes for moving the antenna 204. Such drive mechanisms are understood in the art. The motion controller 408 may include preamplifiers, amplifiers, and other electronic hardware for generating analog command signals 418 that are used to drive motors or other electromechanical devices in the rotating assembly 412.

The I/O unit 406 may be in communication with network 308. Data packets 420 may be communicated between the I/O unit 406 and network 308. The data packets 420 may include information received within the communication signals 210 in the form of digital data. Additionally, the data packets 420 may include position signals indicative of the position of the antenna 204. In one embodiment, the position signals may include actual or relative position signals to allow an operator located in the NOC 302 to monitor position in operation of the position controller 202 and antenna 204.

As previously described, there are several operational modes that the position controller 202 can operate. The operational modes may include an automatic, semi-automatic, and manual mode. The position controller 202, however, can have several different configurations depending upon the mode that the position controller 202 is designed to operate. For example, in the automatic mode, the position controller 202 may include software 404 that operates independent of receiving any external inputs from the NOC 302 by receiving the communication signals 210 received by the antenna element 208 and processing those signals to determine a precise direction that the antenna 204 is pointing. It should be understood that because of the precision used to communicate and receive the signals to maintain a signal-to-noise ratio without losing information being communicated in the communication signals 210. In a semi-automatic mode, an operator at the NOC 302 may communicate signals to the position controller 202 via the I/O Unit 406 to cause the processing unit 402 to automatically re-align the antenna 204. An operator at the NOC 302 may issue the re-alignment command to the position controller 202 when the communication signals 210 are determined by an operator to be below a threshold value, for example. Alternatively, the operator may issue a re-calibration command to the position controller 202 as a routine procedure to ensure quality communications. Still yet, an operator may issue a re-calibration command signal to the position controller during or after a weather phenomenon, such as a thunderstorm to ensure that the antenna 204 is properly aligned. The position controller 202 may operate in a manual mode by having software 404 operate as a slave to position commands communicated from the NOC 302 via the I/O unit 406. The position commands may be generated by an operator entering information via a graphical user interface (FIG. 5) or pointing device, such as a computer mouse or joystick. In one embodiment, the software 404 is configured to receive position commands and communicate the commands to the motion controller 408, which, in response, drives the rotating assembly 412 to move the antenna 204 to the desired position. An operator may receive feedback of the position of the antenna 204 in a number of ways, including signal strength of the communication signals 210 being received by the antenna element 208, position sensors contained within the rotating assembly 412, or otherwise as understood in the art. In the case of position sensors being utilized, the rotating assembly 412 may include mechanical, electrical, or optical sensors that monitor absolute or relative positions of the antenna 204.

Figure 5:
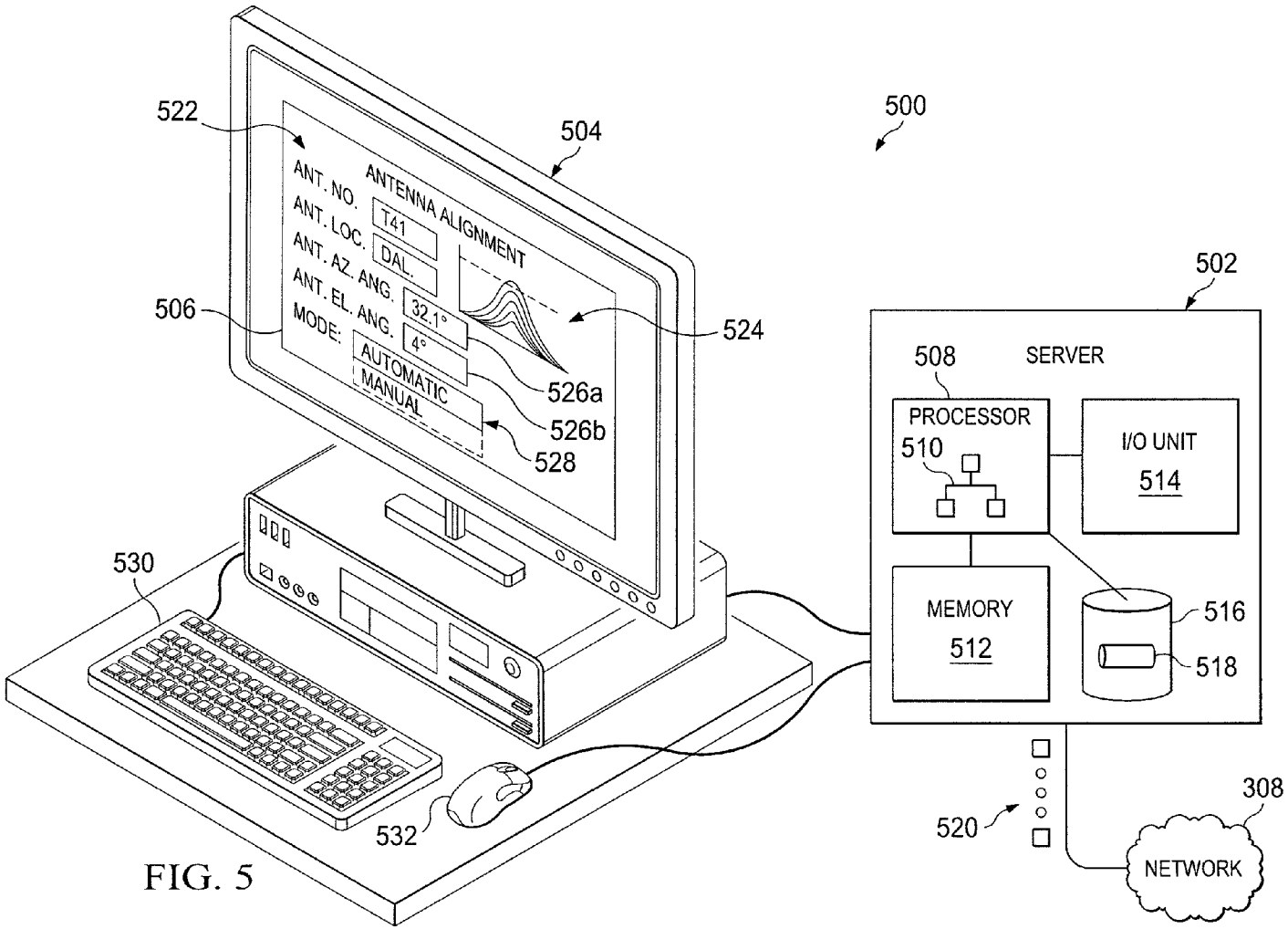
FIG. 5 is a depiction of an exemplary remote controller operating within a network operations center.

FIG. 5 is a depiction of an exemplary remote controller 500 operating within a network operations center. The remote controller 500 may include a server 502 or other computing device that is used to receive information via network 308 from a position controller (not shown). The server 502 may be in communication with an electronic display 504 that may be utilized to display a graphical user interface (GUI) 506 that an operator may use to interface and control position of an antenna via a position controller, for example. The server 502 may include a processor 508 that executes software 510. The processor 508 may be in communication with a memory 512, I/O unit 514, and storage unit 516 that may store a database 518 thereon.

The software 510 may be configured to collect information being communicated via data packets 520 representative of position information of an antenna and information communicated in communications signals being received at the antenna. In one embodiment, the position information is representative of power received by antenna elements at different quadrants, thereby enabling the software 510 to determine a direction to adjust or re-align an antenna. In another embodiment, the position information may be representative of angular position relative to an initial position of the antenna in both azimuth and elevation directions. The information received by the processor 508 may be stored in the memory 512 during operation or in the database 518.

The position information, whether communicated from a position controller at an antenna (not shown) via the network 308 or generated by the server 502, may be displayed on the GUI 506. The GUI 506 may include a display portion 522 that includes information associated with one or more antennas. The information associated with the antenna(s) may include antenna number, antenna location, antenna azimuth angle, antenna elevation angle, and mode (e.g., automatic) for re-aligning the antenna. In addition, the GUI 506 may include a graphics portion 524 that may display power or signal strength associated with communication signals being received by the antenna. Alternatively or additionally, the graphics portion 524 may display a graphical representation of absolute or relative angle of the antenna as currently positioned. For example, a graph showing azimuth and elevation angles relative to boresight as originally positioned and calibrated may be displayed using Cartesian or other graphical format. An operator may manually adjust position of the antenna by entering new azimuth and elevation values in text entry fields 526*a* and 526*b*, respectively. Rather than using text entry fields, it should be understood that other graphical user interface elements, such as up and down arrows, may be utilized for adjusting position of the antenna. Furthermore, the operator may select the mode of operation of the position controller by selecting automatic, semi-automatic, or manual in entry field 528. If selected to be in automatic mode, the position controller 202 may operate to re-align the antenna independent of commands by the remote controller 500. The operator may use a keyboard 530 or pointing device 532, such as a computer mouse, joystick or otherwise. The software 510 may be configured to re-align antennas in manual, semi-automatic, and automatic modes. In one embodiment, the software 510 may be configured the same or similar to the software in the position controller 202 of FIG. 4, whereby the software determines the position of the antenna by determining power levels being received by the antenna elements at each quadrant. In making such a determination, a calibration signal may be communicated from a different antenna to the antenna being re-aligned. Command signals for re-aligning the antenna may be communicated via the data packets 520 by the processor 508 via the I/O unit 514 over the network 308 to the position controller associated with the antenna being re-aligned.

Figure 6:
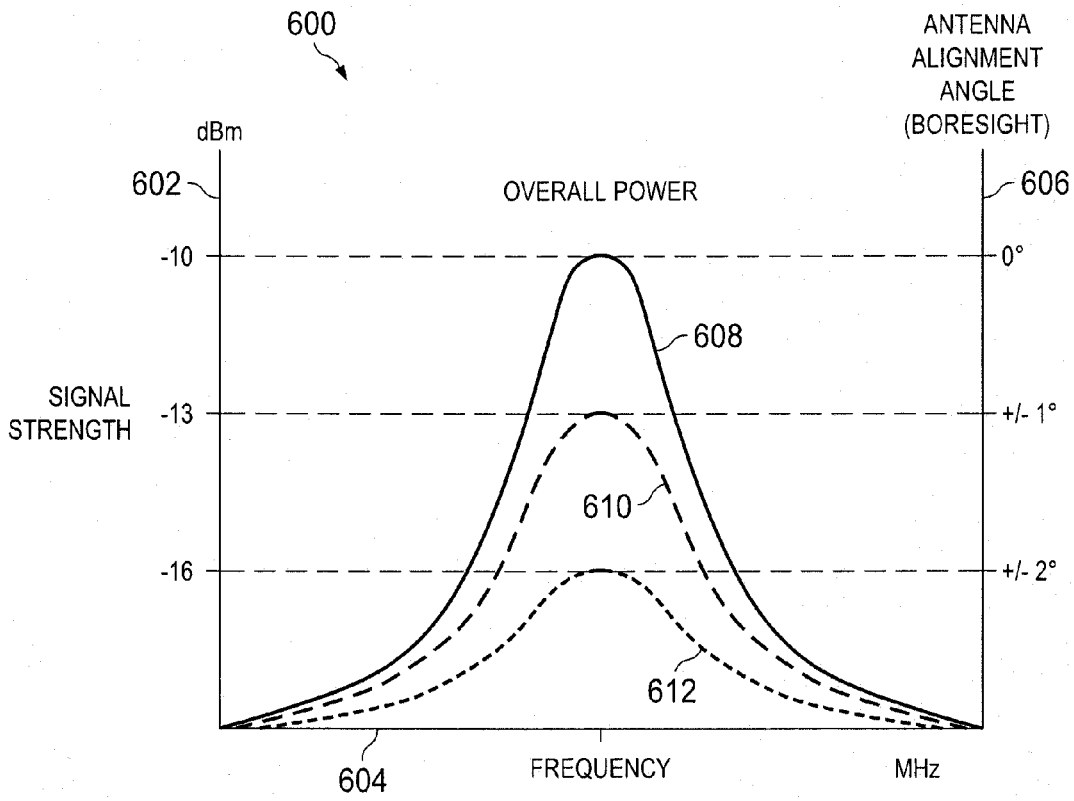
FIG. 6 is a graph depicting overall power of a communications signal received at an antenna.

FIG. 6 is a graph 600 depicting overall power or signal strength of an exemplary communications signal received at an antenna. The graph 600 has three axes, including signal strength on the left vertical axis 602, frequency on the bottom horizontal axis 604, and antenna alignment angle on the right vertical axis 606. Three signal power curves 608, 610, and 612 are shown on the graph 600. Each of these curves 608, 610, and 612 represents an antenna being at different angles with respect to another antenna to which the antenna is communicating. Signal curve 608 is at 0 degrees (boresight) and has a signal strength of −10 dBm Signal curve 610 is at a 1 degree offset angle from boresight and has −13 dBm signal strength. As understood in the art, a difference of −3 dBm is a loss of half of the power from the antenna being at boresight, which means that errors in a communications signal may occur due to the misalignment of 1 degree of the antenna. The signal curve 612 is reflective of the antenna being at a 2 degree offset angle from boresight and has a −16 dBm power level. The −16 dBm power level is 6 dBm below the power level of the antenna from boresight, which is a significant drop below the maximum power level and interruptions of communication may undoubtedly result. Such significant drops for such small angular deviations are a result of the antennas being configured to have point-to-point communications and using a narrow beam for communications.

Figure 7:
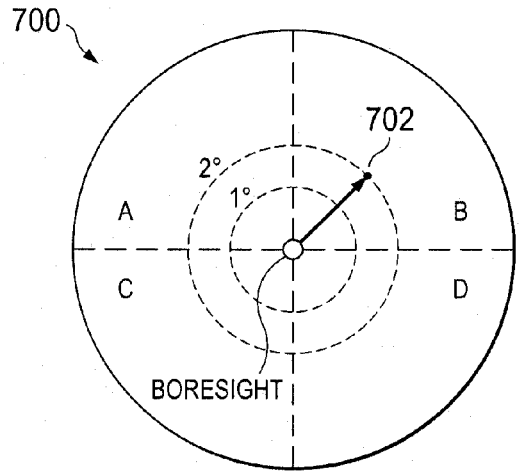
FIG. 7 is a depiction of an exemplary polar chart showing a location of aggregated power of a communications signal being received by an antenna.

FIG. 7 is a depiction of an exemplary polar chart showing location of aggregated power of a communication signal being received by an antenna. The polar chart 700 is configured to have four quadrants, A, B, C, and D. Each of these quadrants are representative of the quadrants of an antenna (see, for example, FIG. 2B). A communications signal received by antenna elements, such as antenna elements 208 of FIG. 2B, may be aggregated to determine position of the antenna so as to determine how to re-align the antenna to cause the antenna to be returned to boresight. As shown, a processor receiving the communications signal from each of the antenna elements determine that the aggregated communications signal is positioned at a point 702 that is 2 degrees offset from boresight. In automatic mode, the position controller or remote controller, depending on which one is controlling re-alignment of the antenna, may determine that the antenna needs to be re-aligned by driving the antenna in both the azimuth in elevation directions in quadrant D so as to move the aggregated communications to boresight.

Figure 8:
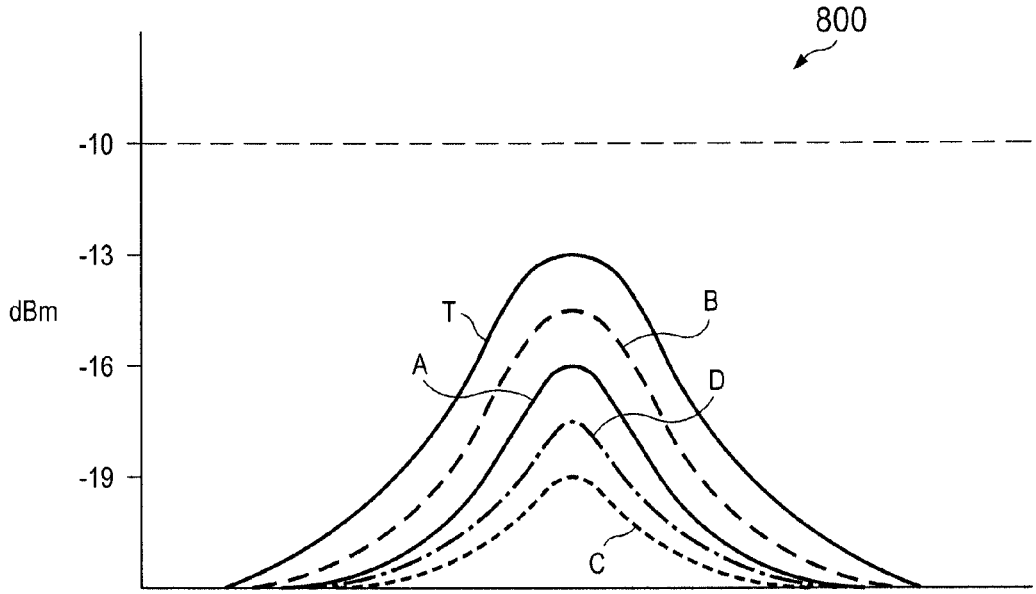
FIG. 8 is a graph depicting signal strength received from various quadrants of an antenna.

FIG. 8 is a graph depicting signal strength from various quadrants of an antenna. Five signal curves are shown, including a total signal curve T and signal curves from each of four antenna elements located in respective quadrants A, B, C, and D. As shown, signal curve B has the highest power level, signal curve A has the second highest power level, signal curve D has the third highest signal level, and signal curve C has the lowest signal power. Aggregating the signal levels of each of the antenna elements results in the signal curve T, which is at −13 dBm. Because the signal levels are spread, the position controller or remote controller can determine that the antenna is not at boresight. In addition, an operator may view the graph 800 and also determine that the antenna is not at boresight. Once the antenna is re-aligned, the individual signal curves A, B, C and D, should substantially overlap with one another and the total signal power curve should increase from −13 dBm to −10 dBm.

Figure 9:
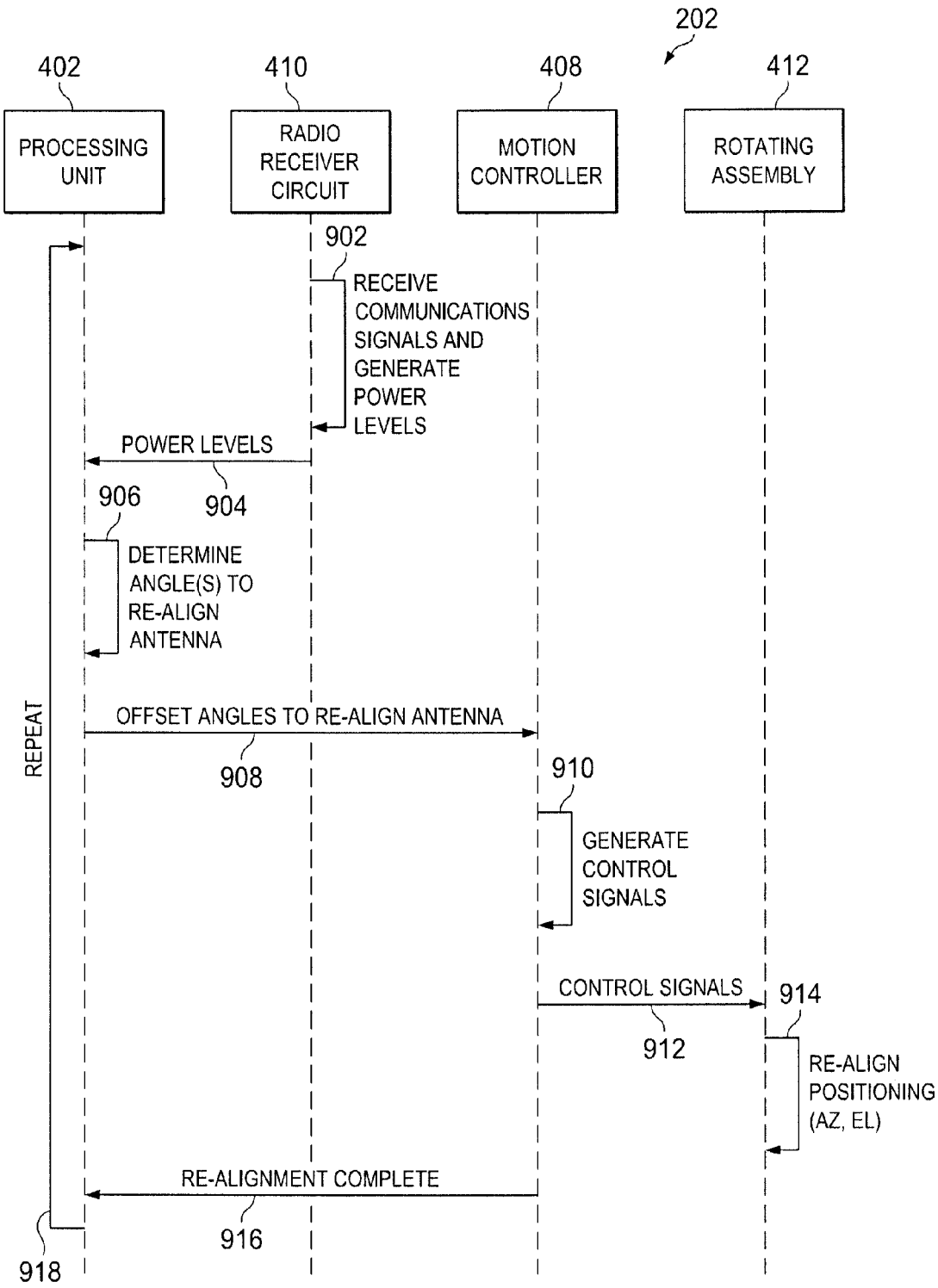
FIG. 9 is a timing diagram representing signal flow between various components of a position controller.

FIG. 9 is a timing diagram representing an exemplary signal flow between various components of a position controller 202. The components of the position controller 202 include a processing unit 402, radio receiver circuit 410, motion controller 408, and rotating assembly 412. It should be understood that these components may be combined or further separated but operate in the same or similar manner as described herein in accordance with the principles of the present invention. The radio receiver circuit 410 receives communication signals and generates power levels at step 902. The power levels generated may be associated with four or more antenna elements that are configured in association with quadrants with an antenna. At step 904 the power levels are communicated from the radio receiver circuit 410 to the process unit 402. In step 906, the processing unit 402 determines one or more angles to re-align the antenna. The angles may be both azimuth and elevation angles. It should be understood that if another coordinate system other than a Cartesian coordinate system is used, then other parameters may be generated. For example, the processing unit 402 may determine distance and angle (r, ø) if a polar coordinate system is being used. At step 908, the processing unit 402 may communicate the offset angles to re-align the antenna to the motion controller 408. At step 910, the motion controller may generate control signals that are used to drive the rotating assembly 412. At step 912, the control signals may be communicated to the rotating assembly 412 and the rotating assembly, in response, performs a re-align positioning of the antenna in both azimuth and elevation planes. In response to the motion controller 408 completing re-alignment of the antenna via the rotating assembly 412, the motion controller 408 may communicate and indicated to the processing unit 402 that the re-alignment is complete at step 916. At step 918, the processing unit may repeat the process of re-aligning the position of the antenna. The re-alignment process may be performed continuously, periodically, in response to an event, in response to a manual notification by an operator, or at any other interval. For example, the processing unit 402 may be configured to wait for the power levels 904 to drop below a threshold level, optionally established by an operator using a GUI, in the aggregate or at each antenna element before performing a re-alignment operation. Alternatively, in the case of monitoring position of the antenna relative to boresight, the antenna may be re-aligned in response to becoming out of alignment by a predetermined angle (e.g., 1 degree).

By having the ability to re-align the antenna automatically or remotely, an operator of the antenna may have costs substantially reduced due to not having a technician having to climb a tower to perform the antenna re-alignment. Furthermore, quality of the antenna and communications system may be improved by not having communications problems caused degradation of communication signals for point-to-point communications. Although described as dish antennas, other types of antennas having narrow beam widths for point-to-point communications that can utilize the principles of the present invention may be utilized.

Figure 10:
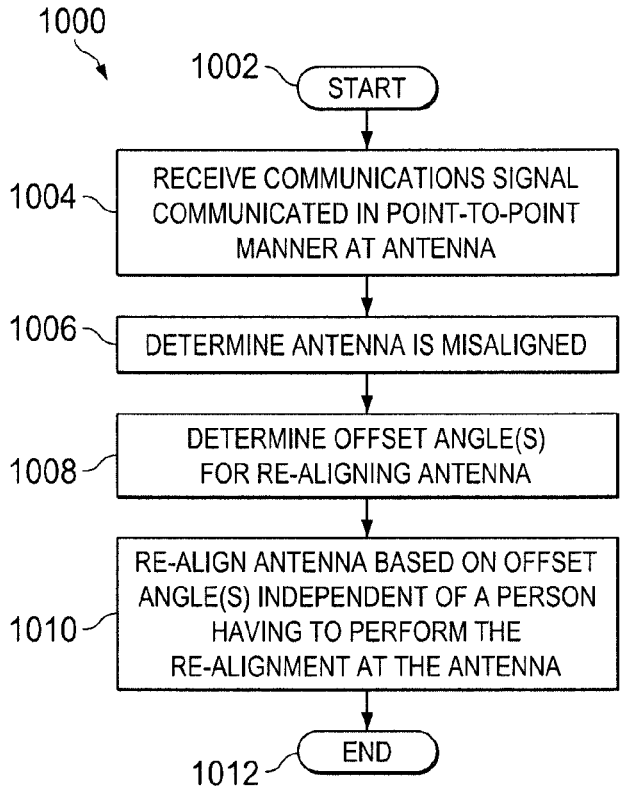
FIG. 10 is a flow chart of an exemplary process for re-aligning an antenna.

FIG. 10 is a flow chart of an exemplary process 1000 for re-aligning an antenna. The process 1000 starts at step 1002. At step 1004, a communications signal communicated in a point-to-point manner (i.e., a dedicated communications link from one antenna to another antenna) is received at an antenna. At step 1006, a determination is made that the antenna is misaligned. The determination may be made using one of a number of different techniques, including determining that power of the communications signal has dropped below a threshold value, determining that an aggregated power location of the communications signal (i.e., the effective center of power) has moved from a boresight location to an off-boresight location on the antenna, determining that the antenna has physically moved based on electromechanical (e.g., motor, gear, potentiometer, etc.) or optical components (optical encoder) sensing an offset from an initial or calibrated boresight position. At step 1008, offset angle(s) in azimuth and elevation planes are determined for re-aligning the antenna to be at boresight. The determination may be made automatically, semi-automatically, or manually. In addition, the determination may be made at the antenna (e.g., by a position controller at the antenna location), remotely (e.g., by a remote controller over a network or manually by an operator at the remote controller). The antenna may be re-aligned based on the offset angle(s) independent of a person having to perform the re-alignment at the antenna at step 1010. In other words, the antenna may be re-aligned using electromechanical components without a technician or other person having to climb a tower or otherwise physically access the antenna to move the antenna into a re-aligned position. The re-aligning may use automatic control feedback algorithms (e.g., PID controller), non-feedback control methods (e.g., slave commands to a stepper motor), or manually (e.g., graph or other image on a GUI at a remote controller). The process ends at step 1012.

The previous description is of at least one embodiment for implementing the invention, and the scope of the invention should not necessarily be limited by this description. The scope of the present invention is instead defined by the following claims.

What is claimed is:

1. A system for re-aligning an antenna communicating signals point-to-point, said system comprising:

a first antenna with at least four antenna elements positioned in different respective quadrants to receive a communications signal in each of the respective quadrants;

a second antenna configured to communicate a communications signal with said first antenna using point-to-point communications;

a position controller coupled to said first antenna including a processing unit configured to receive digital data associated with the communications signals received by each of the at least four antenna elements and determine signal strength of each respective communications signal, the position controller:

configured to re-align said first antenna with respect to said second antenna in response to determining a misalignment of said first antenna by determining an offset angle from boresight, and further configured to re-align said first antenna with respect to said second antenna based on the signal strength of each respective communications signal and by using difference and summation functions with the signal strengths of each respective communications signal to determine an offset distance.

2. The system according to claim 1, wherein said first and second antennas are dish antennas.

3. The system according to claim 1, wherein the communications signal is a WiFi signal.

4. The system according to claim 1, wherein said first and second antennas are mounted to antenna towers and located at least 50 feet above ground.

5. The system according to claim 1, wherein re-alignment of said first antenna includes re-aligning said first antenna in both the azimuth and elevation directions.

6. The system according to claim 1, further comprising a remote controller located remotely from said position controller via a network, wherein said position controller includes an input/output (I/O) unit configured to communicate over the network with said remote controller.

7. The system according to claim 6, wherein said position controller communicates the communications signals via the I/O unit to said remote controller for determining and communicating re-alignment signals to said position controller to re-align said first antenna.

8. The system according to claim 7, wherein said remote controller includes a graphical user interface to enable a user to control alignment of said first antenna.

9. The system according to claim 8, wherein the graphical user interface enables the user to manually control alignment of said first antenna.

10. The system according to claim 1, wherein said position controller further includes:

a radio receiver circuit in communication with said first antenna and configured to receive the communications signals from said first antenna;

a processing unit in communication with said radio receiver circuit and configured to receive digital signals associated with the communications signals;

a motion controller in communication with said processing unit and configured to generate control signals to re-align said first antenna; and a rotating assembly in communication with said motion controller and configured to receive the control signals and re-align said first antenna in response to receiving the control signals.

11. The system according to claim 1, wherein the communications signal is a calibration communications signal.

12. The system according to claim 1, further comprising:

determining that at least one power level of the communications signal drops below a threshold level; and notifying an operator of said first antenna that the at least one power level of the communications signal dropped below the threshold level.

13. A method for re-aligning an antenna communicating signals point-to-point, said method comprising:

receiving a communications signals at a first antenna by at least four antenna elements positioned in different respective quadrants to receive the communications signal in each of the respective quadrants, the communications signal communicated to the first antenna in a point-to-point manner from a second antenna;

determining that the first antenna is misaligned;

determining at least one offset angle from boresight for re-aligning the first antenna;

determining signal strength received by each antenna element; and re-aligning the first antenna based on the at least one offset angle independent of a person having to perform the re-alignment at the first antenna, wherein re-aligning the first antenna is further based on the signal strength of the communications signal in each of the respective quadrants by using difference and summation functions with the signal strengths in each of the respective quadrants.

14. The method according to claim 13, wherein receiving the communications signal includes receiving the communications signal at a dish antenna.

15. The method according to claim 13, wherein receiving the communications signal includes receiving a WiFi signal.

16. The method according to claim 13, wherein receiving the communications signal includes receiving the communications signal at least 50 feet above ground.

17. The method according to claim 13, wherein re-aligning the first antenna includes re-aligning the first antenna in both azimuth and elevation directions.

18. The method according to claim 13, further comprising communicating the communications signals to a remote controller for determining the at least one offset angle to re-align the first antenna.

19. The method according to claim 13, further comprising displaying information representative of the received communications signal on a graphical user interface to enable a user to control alignment of the first antenna.

20. The method according to claim 19, further comprising controlling alignment of the first antenna in response to the user providing re-alignment control commands via the graphical user interface.

21. The system according to claim 13, wherein the communications signal is a calibration communications signal.

22. The system according to claim 13, wherein said position controller is further configured to initiate a notification to an operator in response to a power level of the communications signal dropping below a threshold power level.

* * * * *